United States Patent [19]

Kinne

[11] Patent Number: 4,831,901

[45] Date of Patent: May 23, 1989

[54] CARPENTERS HAMMER DOUBLE JOLT

[76] Inventor: Arnold L. Kinne, P.O. Box 161, Stirling City, Calif. 95978

[21] Appl. No.: 201,255

[22] Filed: May 23, 1988

Related U.S. Application Data

[63] Continuation-in-part of Ser. No. 43,887, Apr. 29, 1987, abandoned.

[51] Int. Cl.[4] ..... B25D 1/00

[52] U.S. Cl. ..... 81/25; 81/20

[58] Field of Search ..... 81/20, 25; 173/91

[56] References Cited

U.S. PATENT DOCUMENTS

| | | | |
|---|---|---|---|
| 2,282,932 | 5/1942 | Burneh | 81/25 |
| 2,776,689 | 1/1957 | Falzone | 81/25 |
| 3,088,506 | 5/1963 | Biachini | 81/25 |
| 3,130,762 | 4/1964 | Kerr | 81/25 |
| 3,341,261 | 9/1967 | Fenlin | 81/20 |
| 3,948,301 | 4/1976 | Hays | 81/25 |
| 4,006,763 | 2/1977 | Ordonez | 81/25 |

*Primary Examiner*—Judy Hartman

[57] ABSTRACT

A hammer having a spring to augment the magnitude of strike force through application of a sliding weight free-moving as a projectile in a hollow shaft inside the hammer head. The hammer gains impact force through the use of a double impact hammer head with the spring propelling a portion of the inner hammer head mass to a greater velocity than the surrounding position of the head.

1 Claim, 3 Drawing Sheets

CARPENTERS HAMMER DOUBLE JOLT

This is a continuation of Ser. No. 07/043,887 filed Apr. 29, 1987, now abandoned.

BACKGROUND OF THE INVENTION

1. Field of the Invention

This invention relates to a double impact hammers. The present invention is particularly directed towards hammers having built-in sliding ballast plus means for an additional increase to the velocity of the ballast over that developed when the hammer is swung.

2. Description of the Prior Art

From a search conducted, the past art patents disclosing devices which seemed to me most nearly in the nature of my invention included the following:

On Jan. 8, 1957, Falzone was issued U.S. Pat. No. 2,776,689, on a hammer with detachable facings and an emphatic-shock absorbing spring in a tubular shaft.

A patent issued to Bianchini dated May 7, 1963, U.S. Pat. No. 3,088,506, shows a non-recoiling, interchangeable head hammer.

Kerr was issued U.S. Pat. No. 3,130,762, dated Apr. 28, 1964, which illustrates a hammer having a weight imparting material contained within the head and interchangeable strike faces.

U.S. Pat. No. 4,006,763, dated Feb. 8, 1977, was issued to Ordonez for the "Impact Reaction Hammer". A weight in the form of a ring slides externally along the hammer neck for double impacting. No spring or other arrangement for increasing the weight velocity is described or illustrated.

To my knowledge, the foregoing patents represented devices most pertinent to my invention. Although several of the devices appear somewhat similar to my invention, none examined were capable of storing and using energy in the same manner as my hammer. Both the Kerr and Bianchini devices use internal ballasts of a fluid medium or multiple lead shot particles to produce a dead blow effect. Neither provides means to increase the velocity of their ballast beyond the speed of the swinging hammer to gain even further impact force. Fluids or multiple lead shot ballast would also prove time consuming and cumbersome to replace compared to a one-piece ballast used internally as a projectile. Externally positioned ballasts, such as the sliding ring ballast shown by Ordonez, could easily be jammed by dirt or sawdust, and no means is provided to increase the velocity of the ballast beyond the speed of the swinging hammer.

In my invention, deficiencies seen in the past art devices are overcome by providing a double impact hammer structured with a weighted projectile free-moving in a hollow shaft. A coil spring is arranged to load by back pressure and add inertia to the weighted projectile as it is moved forward.

SUMMARY OF THE INVENTION

In practicing my invention, I have developed a hammer having a double impact hammer head with built-in means to propel a portion of the inner hammer head mass to a greater velocity than the surrounding portion of the head. Inside the hammer head is an elongated hollow shaft arranged longitudinally with the hammer head as a projectile shaft. Free-moving in the hollow shaft is a weighted projectile and a compression coil spring. In use the hammer is swung back prior to striking a target, the weighted projectile is forced back against the coil spring at the apex of the back stroke. As the hammer accelerates forward toward the target, centrifugal force pushes the weighted projetile further into the compression spring, compressing and storing energy in the spring. The hammer is swung forward striking the target, velocity is added to the weighted projectile by a "kick" from the unloading spring at the moment of impact. The effect of the "kick" is to increase the inertia of the weighted projectile. As the hammer strikes the target, the first impact of the hammer face is followed by the impact of the weighted projectile with increased inertia striking the back interfacing surface of the hammer face. The produced double impact increases the driving force of the hammer head and reduces the overall weight required in my hammer to accomplish the same driving force as a standard heavier hammer or a typical dead blow hammer.

As an example, my double impact hammer is illustrated in the drawings and described in the specification in a carpentry hammer embodiment. A nail pulling claw, replaceable faces, a storage compartment in the handle base, and a uni-bodied structure illustrate the versatile possibilities of hammer structures using my impact augmenting mechanics.

Therefore, a primary object of my invention is to provide a hammer with double impact inclusions which produces a considerably greater strike force than a standard hammer or dead blow hammer of equivalent weight.

A further object of my invention is to provide a hammer having double impact features for use in varied forms for a variety of applications.

A still further object is to provide a hammer with little or no bounce upon striking an object.

Other objects and advantages of the invention will prove evident with reference to the following description of the illustrated embodiment together with a comparison of the accompanying drawings.

DRAWING REFERENCE NUMBERS

Figure 1:
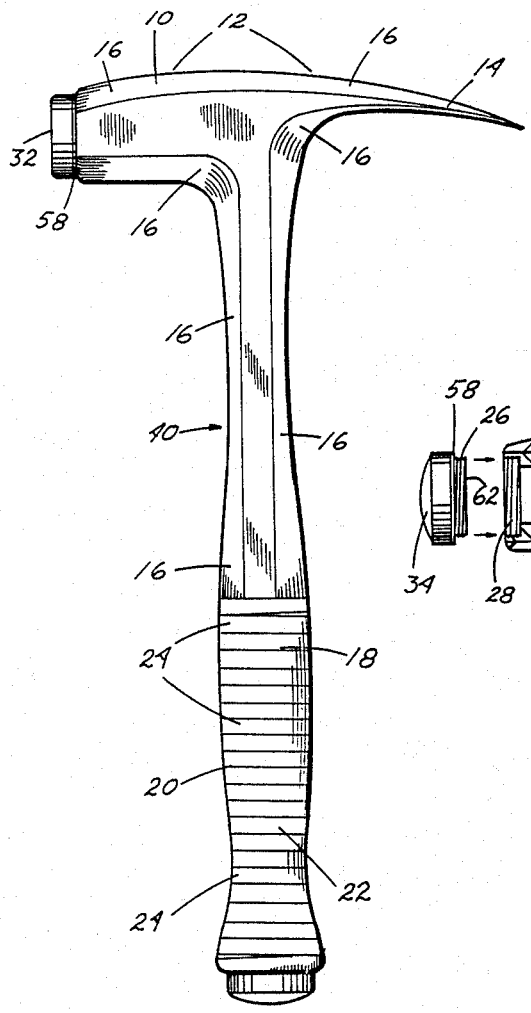
FIG. 1 is a side view of the invention in an illustrative unibody plastic embodiment.

10 neck
12 head
14 nail pulling claw
16 beveled edges
18 rounded handle surface
20 handle
22 handle grip
24 handle grip wrapping
26 male threads
28 female threads
30 face storage insert
32 finish face
34 drywall face
36 framing face
38 metal embodiment
40 plastic embodiment
42 hollow metal shaft insert
44 shaft insert metal claw extension
46 hollow shaft
48 weighted projectile
50 coil spring
52 frame wall
54 nail
58 retaining washer
60 spring retaining screw
62 inner strike surface
64 metal or plastic detachable hammer head
66 handle shaft housing
68 hande receiver shaft
70 handle insert
72 handle wooden or plastic
74 handle spike
76 handle attachment bore
78 metal handle

DESCRIPTION OF THE PREFERRED EMBODIMENTS

Figure 2:
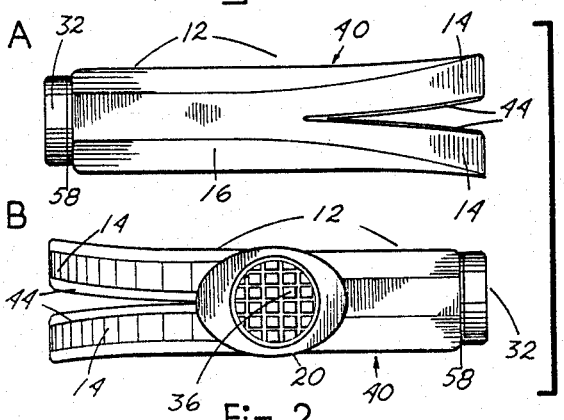
FIG. 2 at A is a top view of the head of the hammer in the various illustrative carpentry hammer embodiments using the present invention, and at B is a view of the bottom of the hammer handle with a stored face attached. Also shown at B is the underneath side of the head at the opposite end of the handle.
Figure 3:
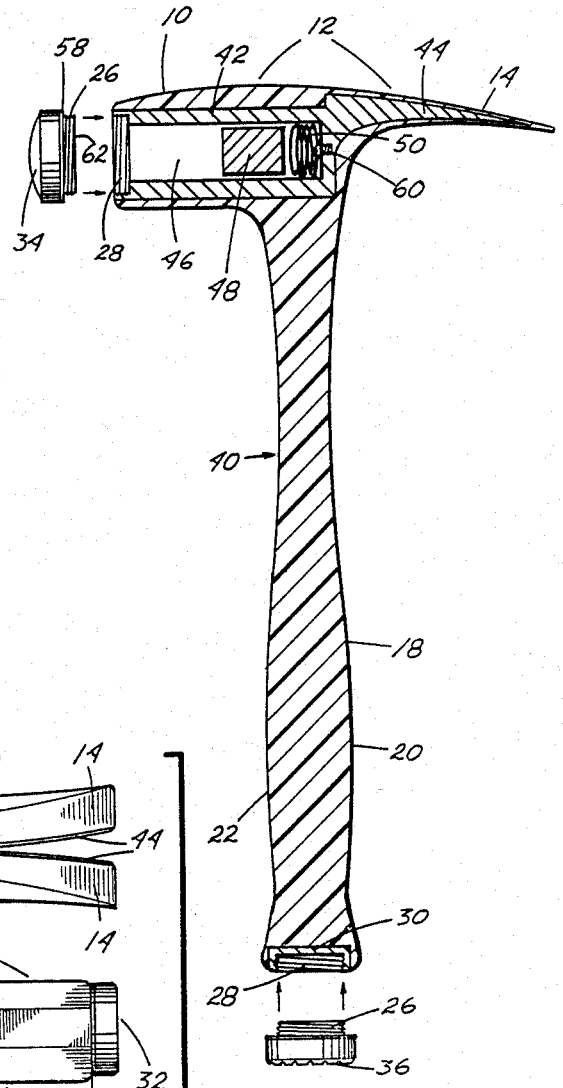
FIG. 3 is a sectional view of the plastic embodiment of FIG. 1 showing both the head and handle structured of plastic or fiberglass and illustrating the metal hollow shaft, the weighted projectile, the spring, and the position of two strike faces ready for attachment.

Referring now to the drawing where the present invention, double impact mechanics and a device for increasing the velocity of a free-moving weighted projectile in a hammer head, is illustrated in a variety of use embodiments. At FIG. 1, a side view of plastic embodiment 40 is shown. Plastic embodiment 40 may be structured of plastic materials, fiberglass, or nylon reinforced plastic compositions sufficiently strengthened for the purpose. Head 12 and handle 20 are single-piece forms for metal fabrication (illustrated FIG. 4 and FIG. 5) but can be structured of separate pieces for handle 20 to be plastic or fiberglass and head 12 to be metal or metal reinforced plastic. Handle 20 has handle grip 22, a rounded handle surface 18, wrapped with handle grip wrapping 24 to improve the gripping surface. Above handle grip 22, handle 20 tapers to a substantially octagonal shape having beveled edges 16 continuing onto the underneath side of head 12. Head 12 has beveled edges 16 also on the upper side giving neck 10 a substantially octagonal shape. Strike faces for different uses can be readily installed in head 12 or stored in the end of handle 20. Finish face 32 is shown installed in head 12 and dry wall face is shown stored in the end of handle 20 in FIG. 1. In FIG. 3, drywall face 34 is illustrated positioned for installation with male threads 26 adjacent the inner strike surface 62 of drywall face 34 are sized for threading into the female threads 28 in neck 10. Retaining washer 58 is the mating surface between neck 10 and the backside of drywall face 34. The framing face 36 to be stored in position for screwing into the bottom end of handle 20 into face storage insert 30. In FIG. 2, beveled edges 16 are shown in a top view of head 12 at A, and a view from the distal end of handle 20 of the underneath of head 12 is shown at B. Also shown in FIG. 2 at B is framing face 36 stored on the bottom end of handle 20. In FIG. 3, a sectional view of the plastic embodiment 40 shows hollow metal shaft insert 42 and shaft insert metal claw extension 44 inside plastic or fiberglass head 12. Shaft insert metal claw extension 44 adds strength to nail pulling claw 14 from inside the outer plastic covering and is extended partially outside of the inner plastic edges of nail pulling claw 14 as shown in FIG. 2 at A and B. In plastic embodiment 40, the metal reinforcement keeps the head of nail 54 from tearing through the inner edges of nail pulling claw 14 during the nail pulling process. Hollow metal shaft insert 42 is centrally opened producing hollow shaft 46, as shown in FIG. 3, and can be used in both metal embodiment 38 and plastic embodiment 40, or hollow shaft 46 can be drilled into or manufactured into metal embodiment 38. Either way, hollow shaft 46 is a hollow hard metal smooth walled shaft housing weighted projectile 48 slidably, and compression coil spring 50 affixed by spring retaining screw 60 oppositely of the strike face towards the claw end of the hammer. Compression coil spring 50 can be free floating within hollow shaft 46 without retainment by spring retainment screw 60 and would function equally well, but would would be more likely to become lost when changing strike faces. Female threads 28 located in the face receiving end of hollow shaft 46 in hollow metal shaft insert 42 are for strike face replacement. The female threads 28 cooperatively fit male threads 26 in removable strike faces which allows finish face 32 to be swapped with drywall face 34 or framing face 36. The stored faces are kept in the bottom end of handle 20. Face storage insert 30 is affixed inside handle 20 at the bottom end and has female threads 28 exposed to cooperatively accept male threads 26 of the exchangeable faces. Retaining washer 58 is fitted over male threads 26 and abutted against the back side of removable framing face 36 to keep the stored face from loosening when the hammer is in use.

Figure 4:
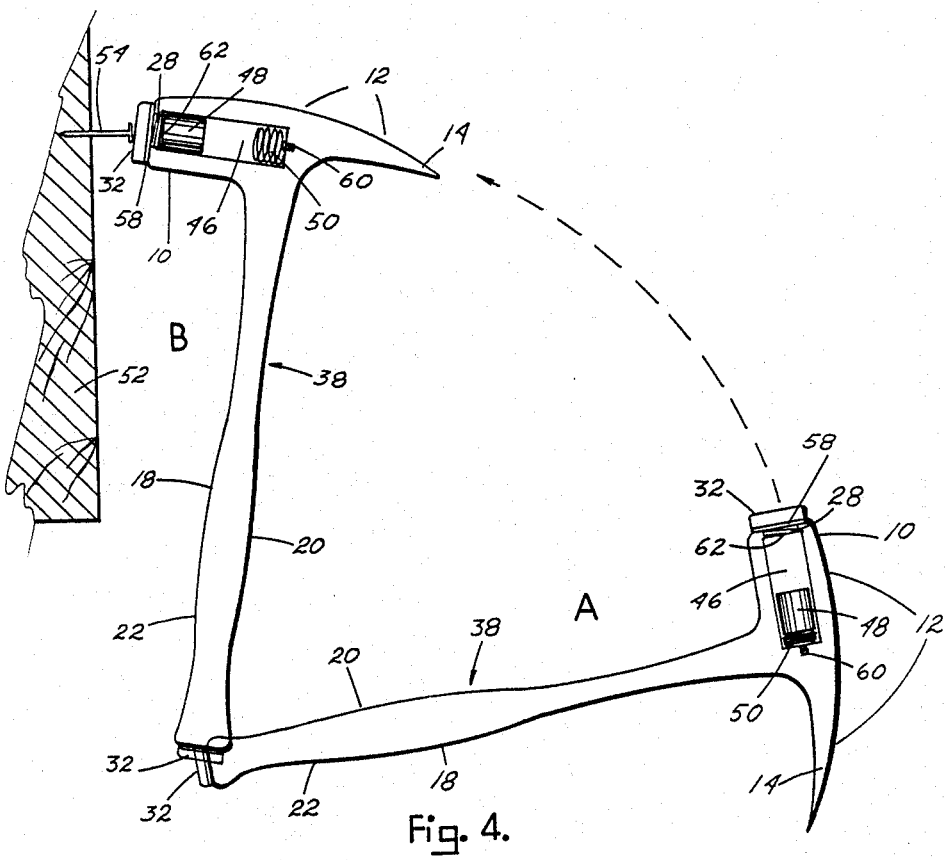
FIG. 4 is a transparent view of a metal embodiment of the subject hammer and illustrates the back swing position at A and the impact position at B with A showing the weighted projectile pressed against the compressed coil spring and B showing the uncompressed coil spring after energy discharge and the position of the weighted projectile to produce double impact when the hammer strikes a nail.

Although the principal invention hereinafter detailed enhances the impact effect in the described carpentry-type claw hammer embodiments, other hammer heads including ball-peen and double-ended dead blow heads can be manufactured with the mechanical structure of the present invention installed for improved efficiency. The double impact efficiency of my device is accomplished by mechanics in head 12 as illustrated in FIG. 4. Slidably contained inside hollow shaft 46 of hollow metal shaft insert 42 is weighted projectile 48 structured of steel or of a steel jacket over lead. Weighted projectile 48 is shown cylindrically shaped with an outside diameter slightly smaller than the inside diameter of hollow shaft 46 which is also illustrated cylindrically shaped. The shapes of both weighted projectile 48 and hollow metal shaft insert 42 may be varied in form so long as both weighted projectile 48 and hollow metal shaft insert 42 are similarly configured for functional purposes. Weighted projectile 48 could also be rounded, squared, triangled, and the like. Centrally positioned between coil spring 50 and inner strike surface 62 of affixed removable framing face 36, weighted projectile 48 moves freely back and forth in hollow shaft 46 as shown in FIG. 4 at A and B. Coil spring 50 is retained by spring retaining screw 60 and is compressed or loaded when head 12 is swung forward as shown in FIG. 4 at A. When head 12 strikes nail 54 in frame wall 52 as shown in FIG. 4 at B, weighted projectile 48 continues to thrust forward and is pushed to a greater velocity by the unloading coil spring 50. Weighted projectile 48 strikes inner strike surface 62 of finish face 32 and produces a double impact driving force of increased overall energy.

In metal embodiment 38, the use of a steel head would eliminate the need for hollow metal shaft insert 42 to be an insert. Hollow shaft 46 can be manufactured as a component of head 12. Also shaft insert metal claw extension 44 would not be needed due to the strength of the steel.

Figure 6:
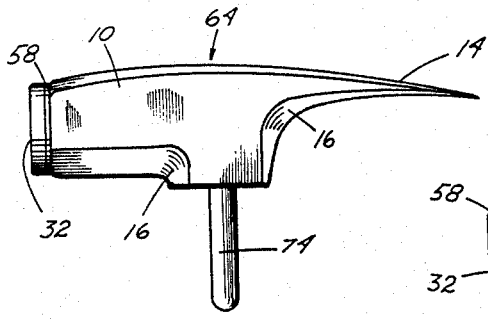
FIG. 6 is a side view of either a metal or plastic embodiment of the subject hammer head illustrating a removable head with a handle spike for attaching the hammer head to a metal handle.
Figure 7:
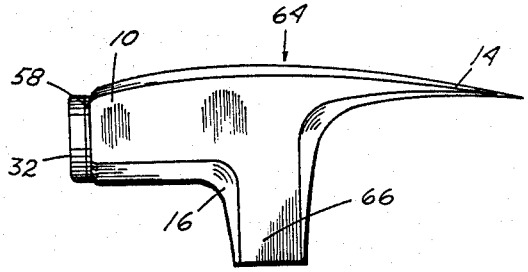
FIG. 7 is a side view of either a metal or plastic embodiment of the subject head illustrating a removable head with a handle shaft housing and a handle receiver shaft for attachment of a wooden or plastic handle.
Figure 8:
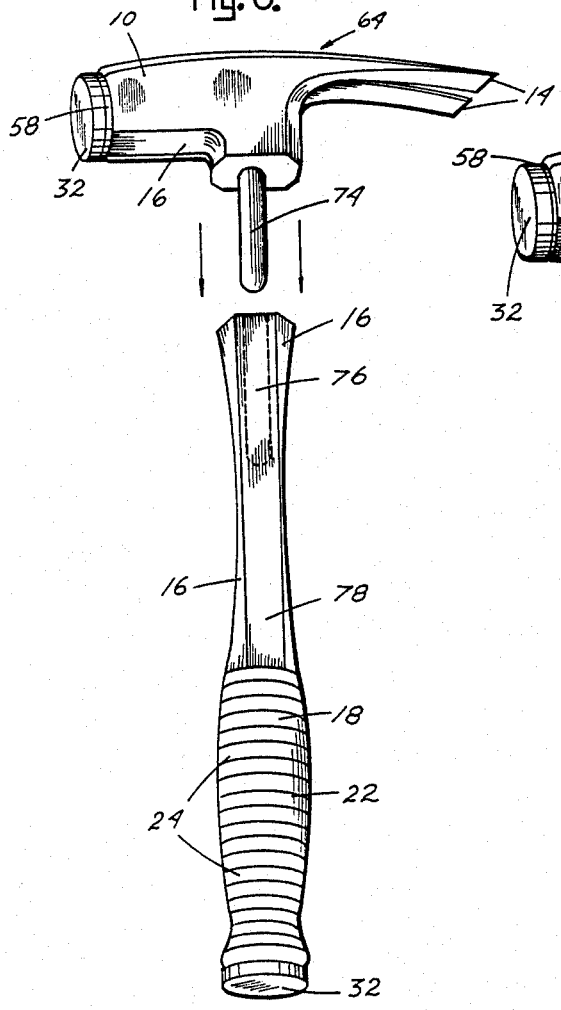
FIG. 8 is a perspective view showing the head of FIG. 6 positioned above a metal handle ready for attachment to the handle.
Figure 9:
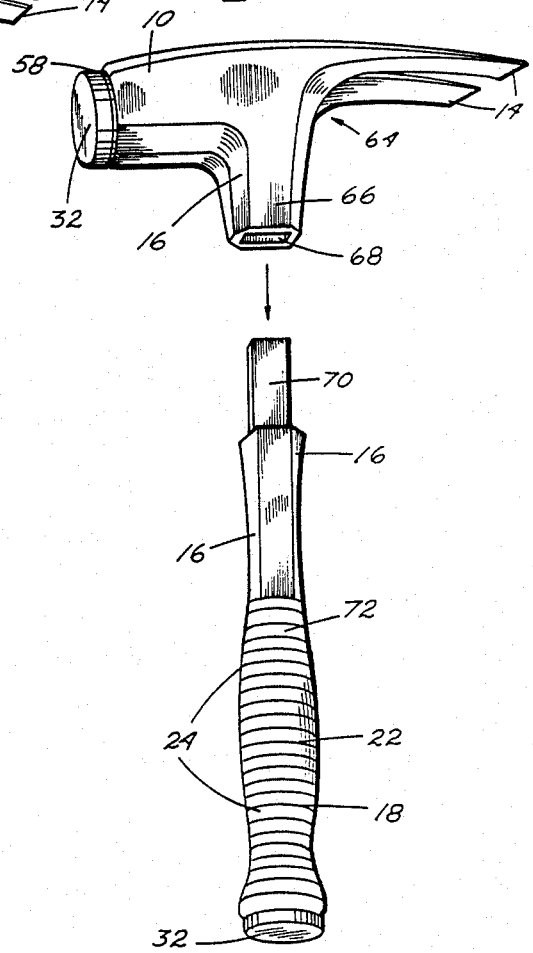
FIG. 9 is a perspective view showing the head of FIG. 7 positioned above a wooden or plastic handle ready for attachment to the handle.

FIG. 6 and FIG. 7 in the drawings illustrate hammer heads incorporating the mechanics of the present invention fitted with handle attachment fixtures. in FIG. 6, metal or plastic detachable hammer head 64 with previously described and numerically numbered members has handle spike 74 affixed downwardly for attachment to metal handle 78. FIG. 8 illustrates how handle spike 74 is positioned for insertion and attachment into handle attachment bore 76 in metal handle 78. Attachment of metal handle 78 to metal or plastic detachable hammer head 64 as illustrated in FIG. 8 is usually factory applied but a metal handle 78 can be replaced by heat sealing or pin drilling for secure attachment. Metal or plastic detachable hammer head 64 shown in FIG. 7 is manufactured with handle shaft housing 66 downwardly. Handle shaft housing 66 is opened centrally into handle receiver shaft 68. FIG. 9 illustrates how wooden or plastic handle 72 is fitted into handle receiver shaft 68. Handle insert 70 is usually heat sealed into handle receiver shaft 68, but for replacement, very efficient glues are now available.

Figure 5:
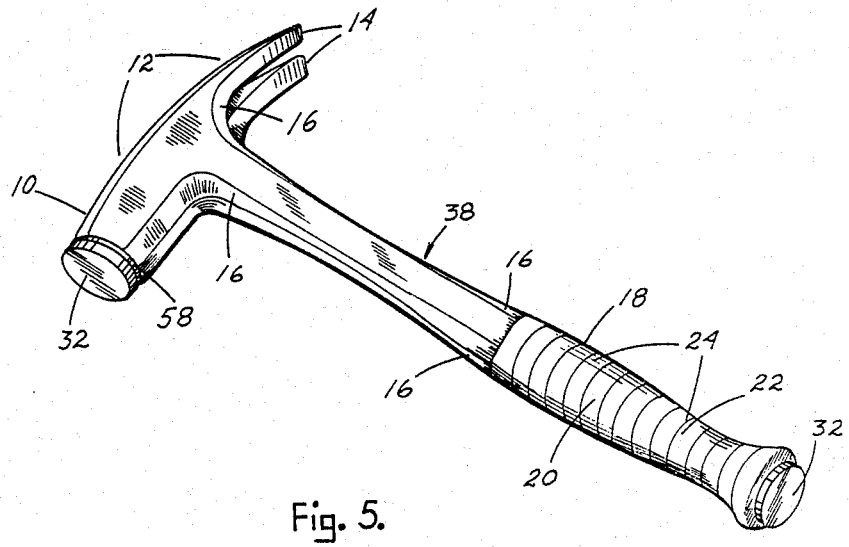
FIG. 5 is a perspective view of the metal fabricated embodiment of FIG. 4.

The plastic embodiment of FIG. 1 and the metal embodiment of FIG. 5 illustrate use embodiments of the present invention with the hammer head and the handle manufactured as a single piece. The illustrations at FIG. 6, FIG. 7, FIG. 8, and FIG. 9 show embodiments of the present invention as hammer heads only where double impact mechanics in the heads makes special handle attachment fittings a requirement as detailed in the previous paragraph.

Although I have described the mechanics of my double impact invention with considerable use details in illustrative carpentry-type hammers and hammer heads in the specification, it is to be understood that the device is not limited to a particular hammer head and that modifications in the design and structure of the invention may be practiced so long as the modifications do not exceed the intended scope of the appended claims.

What is claimed is:

1. A manually operated hammering tool having means to increase velocity of a portion of a hammer head for impact strike force augmentation, comprising:

said hammer head affixed to a handle;

an elongated tubular shaft centrally in said hammer head with said tubular shaft positioned lengthwise perpendicular to said handle, a first end of said tubular shaft closed thermally inside said hammer head, a second end of said tubular shaft closed by an affixed removable strike face of said hammer, said strike face having in inward faced surface in communication with said tubular shaft;

a compression spring longitudinally mobile in said tubular shaft towards and away from said terminally closed end, there being a ballast positioned mobile in said tubular shaft between said inward faced surface of said strike face and said compression spring, there being sufficient longitudinal space in said tubular shaft allowing said ballast to compress said spring during increasing velocity of said affixed strike face towards a target with said compressing of said spring providing impulsion to said ballast fly forward with increased velocity to strike said inward faced surface of said strike face upon impact of said hammer head against said target whereby said ballast provides augmented impact force to said hammer head.

* * * * *